US006223658B1

(12) United States Patent
Rosa et al.

(10) Patent No.: US 6,223,658 B1
(45) Date of Patent: May 1, 2001

(54) NON-LETHAL WEAPON FIRING A FRANGIBLE, WEIGHTED PAINT BALL

(76) Inventors: Steven P. Rosa, 12213 Mt. Albert Rd., Ellicott City, MD (US) 21042; Francis B. Manion, 1705 Evelyn Dr., Rockville, MD (US) 20852

( * ) Notice: Subject to any disclaimer, the term of this patent is extended or adjusted under 35 U.S.C. 154(b) by 0 days.

(21) Appl. No.: 09/186,632

(22) Filed: Nov. 6, 1998

(51) Int. Cl.[7] ..... F42B 10/00
(52) U.S. Cl. ..... 102/501; 102/513
(58) Field of Search ..... 102/501, 502, 102/513; 473/577, 218

(56) References Cited

U.S. PATENT DOCUMENTS

| | | | | |
|---|---|---|---|---|
| D. 337,627 | | 7/1993 | Moran | D21/147 |
| 3,452,453 | | 7/1969 | Ohlund . | |
| 3,510,965 | | 5/1970 | Rhea . | |
| 3,791,303 | | 2/1974 | Sweeney et al. . | |
| 3,865,038 | * | 2/1975 | Barr | 102/501 |
| 3,901,158 | * | 8/1975 | Ferb | 102/502 |
| 3,952,662 | * | 4/1976 | Greenlees | 102/502 X |
| 4,212,460 | | 7/1980 | Kraft . | |
| 4,634,606 | * | 1/1987 | Skogg | 102/502 |
| 4,637,616 | | 1/1987 | Whiting . | |
| 4,936,282 | | 6/1990 | Dobbins et al. . | |
| 4,942,818 | * | 7/1990 | Szxby | 102/502 |
| 5,001,880 | | 3/1991 | Smith . | |
| 5,018,450 | | 5/1991 | Smith . | |
| 5,035,183 | | 7/1991 | Luxton . | |
| 5,161,516 | | 11/1992 | Ekstrom . | |
| 5,166,457 | | 11/1992 | Lorenzetti . | |
| 5,190,196 | | 3/1993 | Hamer, III . | |
| 5,254,379 | | 10/1993 | Kotsiopoulos et al. . | |
| 5,285,765 | | 2/1994 | Lee . | |
| 5,320,358 | | 6/1994 | Jones . | |
| 5,333,594 | | 8/1994 | Robinson . | |
| 5,353,712 | * | 10/1994 | Olson | 102/502 |
| 5,370,056 | * | 12/1994 | Huang | 102/502 |
| 5,413,083 | | 5/1995 | Jones . | |
| 5,448,951 | | 9/1995 | Olson . | |
| 5,450,795 | * | 9/1995 | Adelman | 102/502 |
| 5,462,042 | | 10/1995 | Greenwell . | |
| 5,494,024 | | 2/1996 | Scott . | |
| 5,505,188 | | 4/1996 | Williams . | |
| 5,515,838 | | 5/1996 | Anderson . | |
| 5,639,526 | * | 6/1997 | Kotsiopoulos et al. | 102/502 |
| 5,821,450 | * | 10/1998 | Fedida | 102/502 |

* cited by examiner

*Primary Examiner*—Thomas Price

(57) ABSTRACT

A non-lethal, light weight, paint ball weapon is attached to standard rifles and fits underneath the barrel of the rifle on existing hard points provided for M-203 forty millimeter grenade launchers. A separate triggering system allows the shooter to fire the non-lethal weapon while aligning sights upon an intended target. The paint ball is stabilized by a first immiscible high density component filling approximately one-third of the ball interior volume. Paint or some other liquid is used as a lower density component filling the remaining volume. The high density component may be talc powder, lead shot, sand, glass beads, or a high density substantially immiscible liquid, paste or gel. The specially adapted, stabilized paint ball includes a colorant or dye and, optionally, a skin irritant or odor producing liquid. The ball is enclosed by an elastomeric, fluid impermeable skin scored or marked to ensure immediate bursting and kinetic energy dissipation upon impact. The ball may be filled with a any of a plurality of liquids, thereby providing a baton-marker round, a chemical incapacitating (e.g., oleoresin capsicum) round, a transdermal drug delivery round, a water-filled training round, or an infrared or ultraviolet tagging round. The paint ball ammunition may be color coded for easy identification of the contents and intended use. The weapon fires a selection of paint ball types and includes a plurality of magazines marked with external indicia of ammunition type, or the magazine tubes may include a window, allowing the paint ball condition and color coding to be seen.

32 Claims, 9 Drawing Sheets

NON-LETHAL WEAPON FIRING A FRANGIBLE, WEIGHTED PAINT BALL

BACKGROUND OF THE INVENTION

1. Field of the Invention:

The present invention relates to a non-lethal weapon for firing a stabilized, rupturable paint ball ammunition. The stabilized ammunition of the present invention is a specially adapted "paint ball" and ruptures on impact, delivering an impact shock or sting to targeted personnel, along with marking paint, dyes, odor containing liquids or other materials, to provide a deterrent effect in civil peacekeeping roles.

2. Discussion of the Prior Art:

A variety of non-lethal methods and instrumentalities have been employed in civil peacekeeping efforts to control rioters while minimizing life-threatening injuries and the negative publicity resulting from such injuries, especially to women and children.

Fire hoses have been employed as instruments for riot control, but have largely been abandoned for such uses, due to the substantial potential for injury. Water cannons have also been used and, while the water cannon has advantages over the fire hose, it nevertheless has a substantial injury producing potential. Technically, the fire hose and the water cannon systems utilize a similar principal of projecting a variable intensity water jet stream to unbalance or disarm a targeted individual. Water cannons and fire hoses also have additional drawbacks in that they are large, heavy, cumbersome and normally require several persons and expensive ancillary equipment for transportation and operation.

The advantage of using the water cannon or fire hose is that specific individuals and barricades may be targeted without harming everyone in an area. A lack of ability to discriminate a targeted individual or group from others is the problem confronted with use of tear gas canisters in crowded areas. Once tear gas (or any other chemical gas deterrent) has been released into the atmosphere, it is virtually impossible to control where the gas travels and therefore it is very difficult to target particular individuals in a rioting mob. Collateral damage to innocent bystanders (e.g., journalists) is an unacceptable consequence encountered in using tear gas.

Conventional firearms may be used with elastomeric projectiles such as rubber bullets, however, such use involves a risk of lethal injury if the targeted individual is accidentally struck in the eye or the throat. The mass and velocity required for acceptable accuracy in an elastomeric projectile at useful ranges gives excessive energy at close-in ranges, thus, a policeman using elastomeric projectiles must be extremely skillful and cautious in choosing targets and cannot respond to an assailant at close range without risking serious injury. There is also a risk that the policeman, in the heat of the moment, may mistakenly insert a magazine containing the wrong kind of ammunition into a conventional firearm, thus leading to a catastrophic loss of life.

Use of conventional fire arms and ammunition in riot control has been demonstrated to have terrible and long-lasting consequences, both for the victims of the shooting and for the agency employing such deadly force. History records that the demonstrators at Kent State University in Ohio and in Tienanmen Square in Beijing were subdued with deadly force in what now are regarded as senseless tragedies. The use of deadly force, such as rifle or pistol fire from conventional weapons, has therefore been deemed an unacceptable response to civil disobedience.

There has been a long felt need, then, for a non-lethal weapon which may be deployed safely and efficiently, and which overcomes the problems associated with the prior art.

OBJECTS AND SUMMARY OF THE INVENTION

Accordingly, it is a primary object of the present invention to overcome the above-mentioned disadvantages of the prior art by providing a non-lethal weapon for efficiently and effectively targeting particular individuals in a disorderly crowd and applying a non-lethal deterrent force to those targeted individuals.

A further object of the present invention is to provide a light weight, non-lethal weapon for use by an individual shooter; the weapon fires a rupturable, liquid-filled paint ball projectile of special design.

Paint ball gaming has become a popular sport and permits participants to practice combat tactics and maneuvers in relative safety since rupturable paint balls provide a non-lethal marker for those who have been "shot" and thus disqualified from continuing play. A paint ball customarily includes an elastomeric, liquid impermeable shell filled with liquid paint or dye for marking hits on opposing personnel or objects. U.S. Pat. No. 5,254,379 (Kotsiopoulos et al.) discloses a structure and method for making a paint ball (and is incorporated in its entirety herein by reference). The paint balls of the prior art do not provide a sufficient physical deterrent to use as a non-lethal weapon in civil peacekeeping roles, however, since the prior art paint balls do not provide sufficient impact shock. Paint balls of the prior art also spin in flight, resulting in an unduly limited range for accurate fire.

It is, therefore, a further object and feature of the invention to provide an improved, stabilized, low-hazard, paint ball ammunition enabling accurate, long-range delivery of a marking liquid or other liquid agents to a targeted person; the paint ball ruptures and provides a substantial kinetic shock on impact, thereby preventing paint ball reuse against the shooter.

Another object of the present invention is to provide a non-lethal weapon for firing the stabilized paint-ball ammunition of the present invention from beneath the barrel of a conventional service rifle, thereby permitting a policeman or soldier to carry a conventional rifle for which use is well and widely trained and permitting use of conventional rifle sights.

Yet another object of the present invention is to provide the non-lethal weapon affixed beneath the barrel of a conventional rifle with a separate trigger mechanism, thus reducing the likelihood that lethal force will accidentally be used.

It is also an object of the present invention to provide a non-lethal weapon having a plurality of magazines with different kinds of non-lethal ammunition, wherein each magazine is marked with indicia alerting the policeman or soldier of the type of ammunition to be fired.

The aforesaid objects are achieved individually and in combination, and it is not intended that the present invention be construed as requiring two or more of the objects to be combined unless expressly required by the claims attached hereto.

A lightweight, paint ball firing weapon is easily attached to the standard service rifles carried by the military and police (e.g., the M16A2 and the AR-15). The weapon of the present invention is non-lethal and fits underneath the barrel of the M16A2 on the existing hard points provided for the M-203 forty millimeter grenade launcher. A separate triggering system allows the shooter to fire the non-lethal weapon while aligning the sights of the rifle upon an intended target. The weapon is accurate and effective out to a range of beyond one hundred yards when firing the stabilized paint balls of the present invention.

The paint ball of the present invention is stabilized by a first immiscible high density component filling approximately one third of the ball interior volume. Paint or some other liquid is used as a lower density component filling the remaining ball interior volume. The high density component may be talc powder, lead shot, sand, glass beads, steel particles, or a high density substantially immiscible liquid, paste or gel.

The specially adapted, stabilized paint ball of the present invention may include a colorant or dye and, optionally, a skin irritant or odor producing liquid. The ball is enclosed by an elastomeric, fluid impermeable skin scored or marked to ensure immediate bursting and kinetic energy dissipation upon impact. In alternative embodiments, the ball may be filled with a any of a plurality of liquids, thereby providing a baton-marker round, a chemical incapacitating (e.g., oleoresin capsicum) round, a transdermal drug delivery round, or a water-filled training round. Other embodiments will have infrared or ultraviolet (UV) illuminating/tagging dyes for marking a doorway or a vehicle to identify threats or targets for lethal fire in night battle. The paint ball ammunition may be color coded for easy identification of the contents and intended use. The weapon firing a selection of different types of paint ball ammunition preferably includes a plurality of magazines in which the different types are separately stored. Preferably, the magazine tubes are marked with external indicia of ammunition type or, optionally, the magazine tubes may include a window, thus allowing the paint ball color coding and condition to be seen.

Advantageously, the paint ball of the present invention includes, in addition to the liquids discussed above, the charge of higher density, substantially immiscible material, movable freely within the ball interior volume for stabilizing the trajectory of the ball in flight. With the weighted material in the ball interior volume, an unusually accurate paint ball having greater mass and therefore delivering greater kinetic energy is provided for use in non-lethal deterrent and marking applications.

The above and still further objects, features and advantages of the present invention will become apparent upon consideration of the following detailed description of the specific embodiment thereof, particularly when taken in conjunction with the accompanying drawings, wherein like reference numerals of the various figures are utilized to designate like components.

DESCRIPTION OF THE PREFERRED EMBODIMENT

Figure 1:
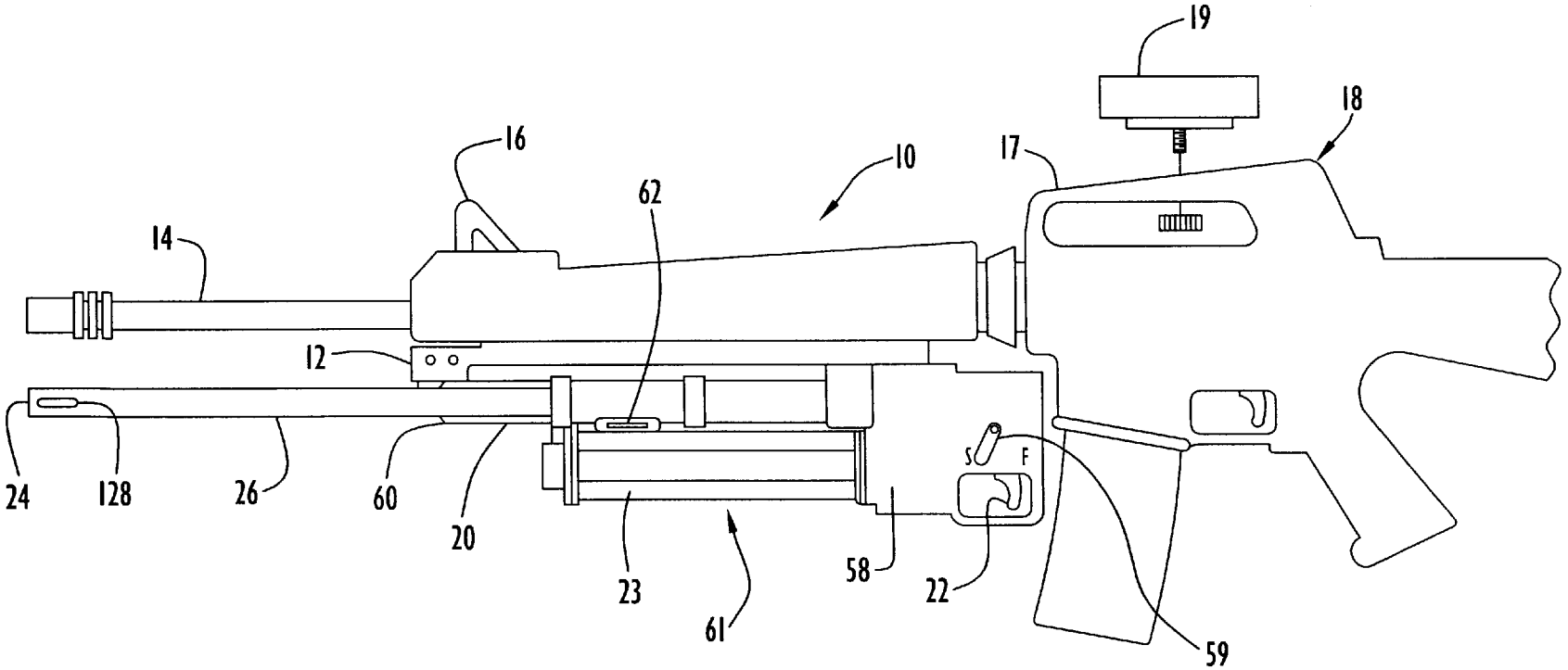
FIG. 1 is a left side view in elevation of the non-lethal weapon of the present invention mounted beneath the barrel of a service rifle.

Referring specifically to FIG. 1 of the accompanying drawings, FIG. 1 illustrates a standard service rifle 10, the M16A2 by way of example, having a hard point or mount 12 under the rifle barrel 14. The rifle includes a front sight post 16 and a carry handle 17 supporting a rear sighting aperture 18 alignable with front sight post 16 for aiming the rifle 10. Optionally, a stadiametric range finder is threadably mounted on carry handle 17. A non-lethal weapon in the form of a pressurized gas powered paint ball gun 20 is mounted on under barrel mount 12 and has a trigger 22. Paint balls are retained within a magazine tube 23 and, upon actuation of trigger 22, are fired from the muzzle 24 at the distal or forward end of the paint ball gun barrel 26.

Figure 4:
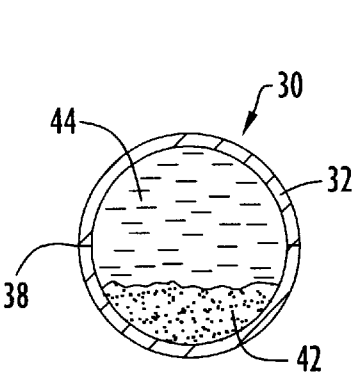
FIG. 4 is a diagrammatic cross sectional view of the filled stabilized paint ball of the present invention.
Figure 3:
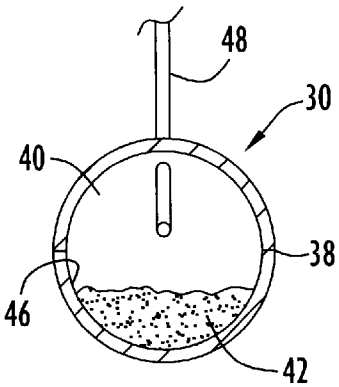
FIG. 3 is a diagrammatic cross sectional view of the stabilized paint ball of the present invention, with filling tube inserted.
Figure 2:
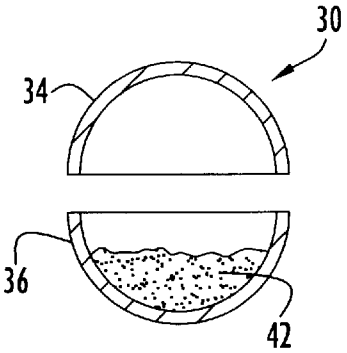
FIG. 2 is a diagrammatic cross sectional view of the hemispheres which are assembled to make the stabilized paint ball of the present invention.
Figure 7:
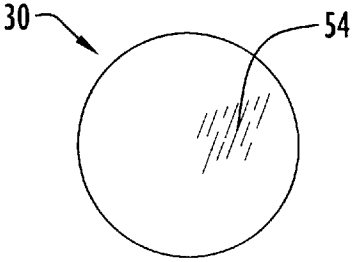
FIG. 7 is a side view in elevation of the exterior of the stabilized paint ball of the present invention.

Turning now to FIGS. 2, 3 and 4, there is illustrated a stabilized paint ball 30 having an elastomeric, fluid-impermeable, substantially spherical shell 32 including an upper shell half 34 and a lower shell half 36 permanently and completely sealed around at least one, preferably equatorial, seam 38. The paint ball 30 has an interior volume 40 filled with a first high density substantially immiscible material 42 and a second lower density material 44, preferably a liquid such as paint or water mixed with a marking agent, or other chemical agent for deterrent or marking purposes, as discussed in further detail below. The interior volume 40 of paint ball 30 is approximately one-third filled with first high density material 42 (e.g., steel particles) and the remainder is filled with lower density fluid 44 (e.g., a liquid such as paint). The first, high density material can be silica, sand, metallic particles, rock salt, sealing wax, talc powder, glass particles or any other high density material which is substantially immiscible with the lower density fluid 44. The particles of high density material are discrete and preferably range in size from a fine powder to the size of BB shot; smaller particle size is preferred because it is less likely to cause injury. By high density material is meant a material with a specific gravity greater than the specific gravity of a second, lower density material paired for use therewith in a projectile, and preferably greater than one (i.e., 1.0); the difference between the specific gravities of the high density material 42 and the lower density material 44 must be sufficient to stabilize the paint ball as described below. The high density material 42 is preferably disposed loosely within the interior volume 40 and is not attached to the interior surface 46 of ball 30 such that in flight, the high density material 42 can move freely therethrough and therearound within the paint ball interior volume 40. The second, lower density material 44 is a fluid, preferably a liquid of sufficiently low viscosity to permit the high density material 42 to move about within the interior volume of the ball and can be paint, oil, alcohol, or water with colorants, chemical irritants, odor producing agents, infrared marking dyes, or pharmaceutical agents. A chemical incapacitating round preferably includes oleoresin capsicum (OC) or another chemical incapacitating agent, chloroacetophenone (CN) (i.e., tear gas), preferably included in the second, lower density liquid 44.

In another embodiment, chemical or ferrite powder taggants are added to second, lower density liquid 44 to mark targeted personnel with chemically distinct identifying materials, thus providing evidence that a person or article struck was present at a given time and place. Alternatively, opaque, sticky liquids including adhesive compounds (e.g., liquid glue or epoxy) can be used to clog vents or smear windshields, thus rendering vehicles undriveable. Thus, several different kinds of paint ball ammunition can be provided and each type of ammunition preferably includes a distinct color on shell 32 or is provided with a distinct color of paint or dye.

In the method for making the paint ball 30 of the present invention, a hemispherical upper shell half 34 and hemispherical lower shell half 36 are provided and the lower shell half 36 is partially filled with the first high density material 42 as illustrated in FIG. 2. The upper shell half 34 and lower shell half 36 are then bonded and sealed along seam 38 and a filling tube 48 is inserted through the ball shell exterior skin to be in fluid communication with the ball interior volume 40, as illustrated in FIG. 3. The second lower density liquid material 44 is then inserted into the ball interior volume 40 via the filling tube 48 to substantially fill the interior volume 40 of the paint ball shell 32.

Turning now to the physics underlying the design of new paint ball 30 of the present invention, it can be shown that a normal paint ball spins while leaving the gun barrel and thus inherently has an curved trajectory. Any curving projectile is less accurate than a projectile flying in a straight trajectory. The weighted, stabilized paintball of the present invention does not spin and so will have a much straighter trajectory and be far more accurate, for a number of reasons.

Figure 5:
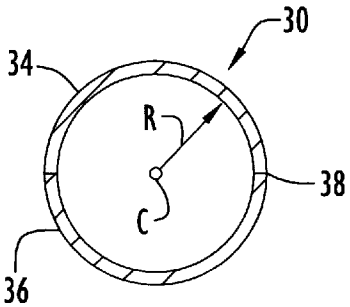
FIG. 5 diagrammatically illustrates a spherical coordinate system for the stabilized paint ball of the present invention.

An analytical approximation of the physical forces involved when a stabilized paintball 30 is accelerating down the gun barrel 26 shows that the "G" forces brought to bear by the first high density material 42 greatly diminish the tendency of a ball to rotate during acceleration. Turning now to FIG. 5, there is illustrated a hollow, spherical ball 30 bisected by an equatorial seam 38 thus defining an upper hemisphere corresponding to upper half 34 and a lower hemisphere corresponding to lower half 36; for purposes of defining a spherical coordinate system, ball 30 has a center C from which is defined a radius R.

Figure 6:
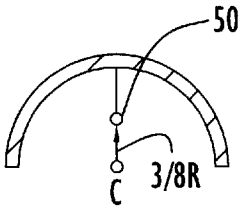
FIG. 6 diagrammatically illustrates a spherical coordinate system for a paint ball hemisphere.

The mass center of gravity (cg) for a hemisphere (e.g., upper half 34) is at ⅜ r on a hemisphere centerline (shown as point 50 in FIG. 6), where r is the radius of the hemisphere. Matching two hemispheres to make a paintball, it is possible to calculate the resultant center of gravity of a paintball made of two separate hemispheres, each containing different density of filler (i.e., first high density material 42 and second lower density material 44). For example, if upper hemisphere 34 filler weighs twice that of lower hemisphere 36, then the net spherical center of gravity can be found. From the balance of moments:

$$w_1 r = w_2 r_2 \qquad \text{(Eqn. 1)}$$

where $r_1$ and $r_2$ are the distances from each respective hemisphere center of gravity to the center of gravity of the total sphere. The distance between the centers of gravity of the two hemispheres is ¾ r (i.e., the sum of ⅜r and ⅜r). The upper and lower hemispheres have the same radius, so that the resulting ball or sphere is round. For example, if $w_1=w_2$ then $r_1=r_2$ and $r_1$=⅜r, the center of the sphere. However, if $w_1$ is greater than or less than $w_2$, then the net sphere center of gravity moves toward the heavier hemisphere center of gravity location. Specifically, $$r_1=(w_2/w_1)r_2, \qquad \text{(Eqn. 2)}$$

therefore, if $w_1=2w_2$, then $r_1=0.5\ r_2$

Thus $r_1+2\ r_1$=¾r, and $r_1$=¼ r, or the net center of gravity location=⅛ r, measured from the center C of the sphere into the heavier hemisphere 34, having $w_1$.

Therefore the sphere's net center of gravity is located at a distance ⅛ r into the heavier hemisphere.

Similar calculations can be made for many different weight ratios. For example let $w_1=3w_2$; this is realistic for converting a three gram paint ball to a stabilized, weighted six gram paint ball, which can be achieved by having 1.5 grams in one hemisphere and 4.5 grams in the other, a weight ratio of three to one. For this case, $r_1$=3/16 r, or the net center of gravity location=3/16 r, measured from the center of the sphere into the heavier hemisphere. If the weight ratio were nine to one, then $r_1$=3/40 r, or the net center of gravity location=3/10 r, measured from the center of the sphere, very close to ⅜ r that would be the center of gravity of the heavier hemisphere center of gravity. As the weight ratio increases, the spherical center of gravity tends toward the center of gravity location of the heavier hemisphere.

The restoring "G" forces of a weighted paintball with the center of gravity thirty degrees off axis (i.e.,$\phi$=thirty degrees) can be analyzed as follows:

$$\text{Restoring Torque}=r_1 \sin \phi g(w_1+w_2) \qquad \text{(Eqn. 3)}$$

Calculations indicate that paintball endures 1000 G's or more during the ball's accelerating trip down the gun barrel 26. For a net six gram paintball, the center of gravity location, $r_1$=3/16 r, where r is the radius of the paintball, $$r_1 \sin \phi=0.06555 \text{ for } \phi \text{ of 30 degrees, } r=0.7 \text{ inches.}$$

Thus, the restoring torque T=(0.0655)(1000)(6) gram-inches (for 1000 g's acceleration), $$=393 \text{ gram-inches.}$$

Thus, the ball rights itself very quickly. In this context, "rights itself" means becomes oriented such that the heavier material 42 is at the rear of the accelerating ball as the ball moves forwardly down the barrel toward the muzzle 24. It can be seen, therefore, that the paint ball 30 has a substantial restoring torque forcing the higher density material 42 to the rear of the ball and prevents the ball from spinning during flight after exiting the muzzle 24.

The immiscibility of the first and second materials 42, 44 and the viscosity of the fluid second material 44 tends to keep the higher density material 42 at the rear of the ball during forward flight, and so prevents spin in flight.

As noted above, it is the relative difference between the specific gravities of the first and second materials which stabilizes the flight of the paint ball. By way of example, the following is a listing of the specific gravities, sg, of different substances:

TABLE 1

| MATERIAL | SPECIFIC GRAVITY | RATIO TO MILK |
|---|---|---|
| Alcohol | 0.80 | 0.77 |
| Aluminum | 2.71 | 2.62 |
| Glycerin | 1.26 | 1.22 |
| Gypsum | 2.31 | 2.24 |
| Lead | 11.35 | 11.0 |
| Mercury | 13.60 | 13.2 |
| Milk | 1.03 | 1.00 |
| Rock Salt | 2.18 | 2.11 |
| Sand | 2.20 | 2.13 |
| Sealing Wax | 1.80 | 1.75 |
| Steel | 7.80 | 7.56 |
| Talc | 2.70 | 2.62 |
| Water | 1.00 | 0.97 |

Milk is used as a reference since the paintball filler specific gravity is somewhere between that of water (1.0) and milk (approx. 1.03). It may be difficult to find a filler for the heavier hemisphere that weighs 3 times that of milk or paint. Talc is the closest, however, a lesser weight ratio still retards paintball rotation in the barrel, but not as effectively. If a six gram paintball is used, the heavier hemisphere would require 30% steel particles and 70% paint filler. If aluminum is selected for the first high density material in a six gram paint ball, more than half of the interior volume must be filled with aluminum particles, with the remainder filled with paint, or the like.

A weighted, stabilized paint ball 30 has increased inertia as compared to conventional 3 gram paint balls but no greater surface area or aerodynamic drag force, and so the stabilized paint ball slows down less in flight and travels further, on a straighter path.

It has also been discovered that flight characteristics are further improved by providing a uniformly dimpled, textured or roughened exterior surface 54. Flight is improved by delaying the onset of laminar flow about the sherical shape in flight, thus reducing drag and lift. If the pattern of dimples or texture is uniform, the sphere will be less likely to tumble in flight and so is more likely to have the desired straight trajectory. Accordingly, in the preferred embodiment, range is extended using a uniformly roughened exterior surface for less aerodynamic drag in flight. Therefore, there are two key improvements for more accurate paintball trajectories: the use of an unbalanced, weighted paintball to suppress rotation while in the gun barrel, and the use of a uniformly roughened surface, thereby causing the onset of turbulent flow and reducing surface drag. Preferably, the paint ball roughened surface 54 includes several lines of micro-scoring, thus reducing the structural integrity of or weakening shell 34 and ensuring immediate bursting and kinetic energy dispersion on impact.

Figure 8:
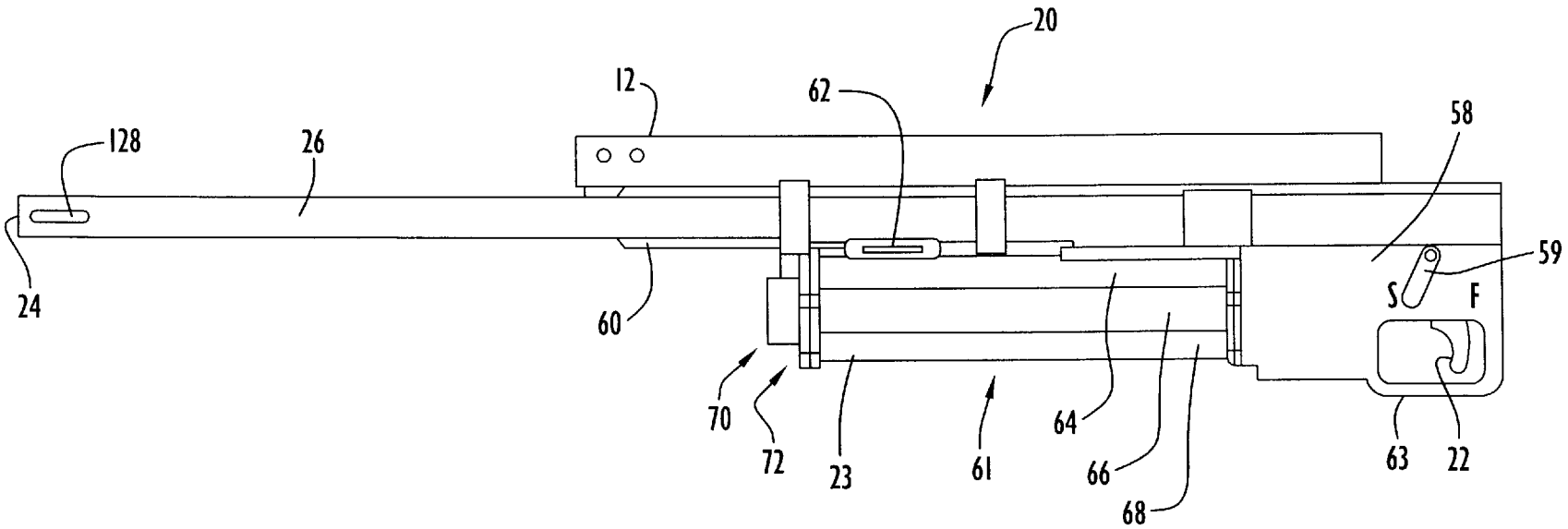
FIG. 8 is an enlarged left side view in elevation of the non-lethal weapon of the present invention.

Turning now to FIG. 8, the paint ball gun 20 is a pneumatic, pressurized gas powered semi-automatic, non-lethal weapon including, within a main body assembly 58, a safety selector switch 59 for selectively enabling trigger 22 which is surrounded by a trigger guard 63. Air or another compressed gas is stored in a compressed air reservoir pressure vessel 60; energy from the compressed gas cycles the semi-automatic action of the paint ball gun and drives the paint balls of the present invention (not shown) down the barrel 26 and out of the muzzle 24.

Figure 9:
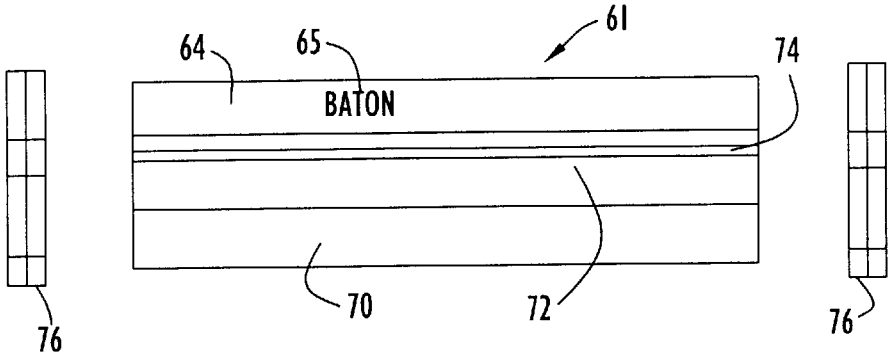
FIG. 9 is an exploded elevation view of the magazine subassembly of the weapon of FIG. 8.
Figure 10:
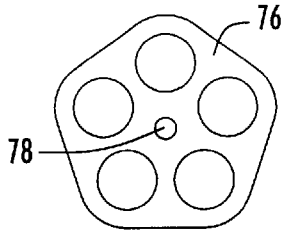
FIG. 10 is a plan view of the end plate of the magazine of FIG. 9.

Paint ball ammunition is stored in the magazine 23 of the rotary magazine subassembly 61. The magazine subassembly 61 is released from paintball gun 20 by operation of a magazine index release 62. Magazine subassembly 61 is illustrated in greater detail in FIG. 9. The opposite side of paintball gun 20 is illustrated in FIG. 10. Magazine sub assembly 61 includes first magazine tube 64 bearing external indicia of projectile type 65, second magazine tube 66, third magazine tube 68, fourth magazine tube 70 and fifth magazine tube 72, including a clear plastic window strip 74, all radially spaced about a central axis. As illustrated in FIG. 10, rotary magazine subassembly 61 is rotatable around a dowel or center shaft coaxially fitted within central axis aperture 78 in end plate 76.

Figure 12:
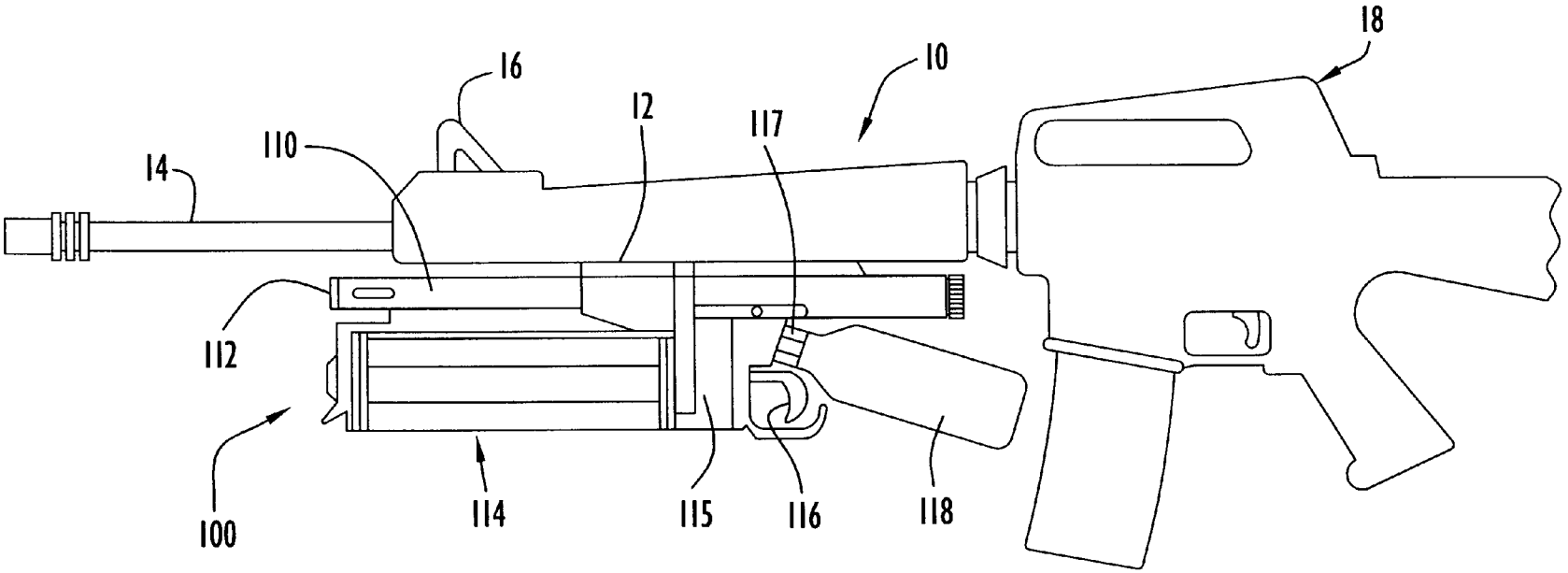
FIG. 12 is a left side view of a second embodiment of the non-lethal weapon of the present invention mounted beneath the barrel of a service rifle.

Turning now to FIG. 12, there is illustrated a second embodiment of the paintball gun of the present invention 100 also mounted on service rifle 10 at mount 12 under barrel 14. The second embodiment of the non-lethal paint ball weapon 100 includes a shorter barrel 110 terminating in a muzzle 112 at the barrel forward or distal end. Paint ball gun 100 also incorporates an array of five magazine tubes in a rotary magazine subassembly 114 which is detachable from the main body subassembly 115. Main body subassembly 115 incorporates paintball gun trigger 116 and the connecting coupler or fitting 117 for receiving compressed air reservoir 118.

Figure 13:
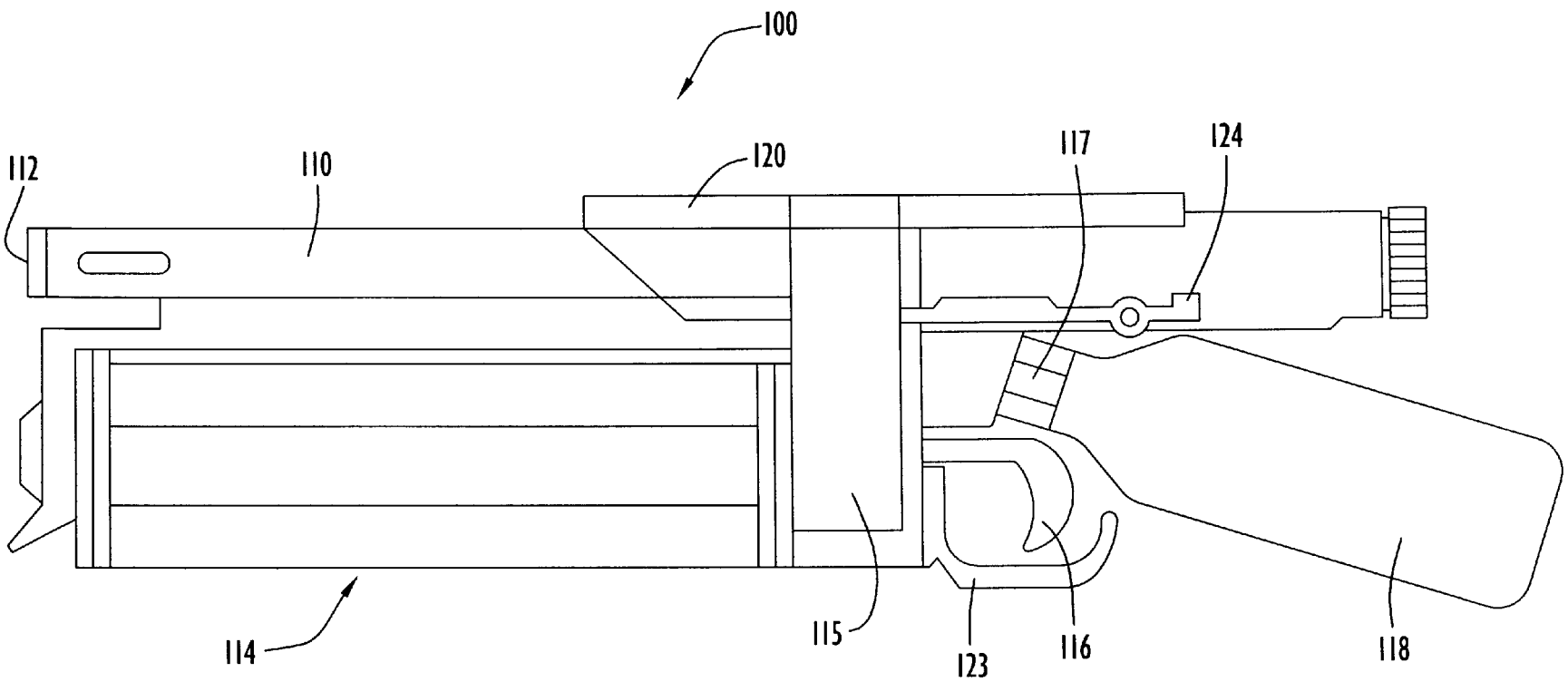
FIG. 13 is an enlarged left side view in elevation of the embodiment of FIG. 12.

Turning now to FIG. 13, paintball gun 100 is illustrated in greater detail. It can be seen that main body subassembly 115 includes rifle mount clamp 120 and trigger guard 122 as well as the magazine index release 124.

The paintball gun of the present invention 20 utilizes compressed gas as the pneumatic propellant for providing accelerating force to the stabilized paintball 30 of the present invention. Preferably, either compressed air or nitrogen is used as propellent. $CO_2$ gas is less desirable as a propellant since propellant utility is lost at temperatures of below approximately 0° F., whereas compressed air and nitrogen gas retain full propellant utility throughout the anticipated range of temperatures. Compressed air is far more readily available around the world than is compressed nitrogen and can be generated at virtually any location using commercially available equipment familiar to scuba diving and fire fighting organizations. Compressed air is therefor the preferred propellant for use with the paintball gun of the present invention.

Figure 11:
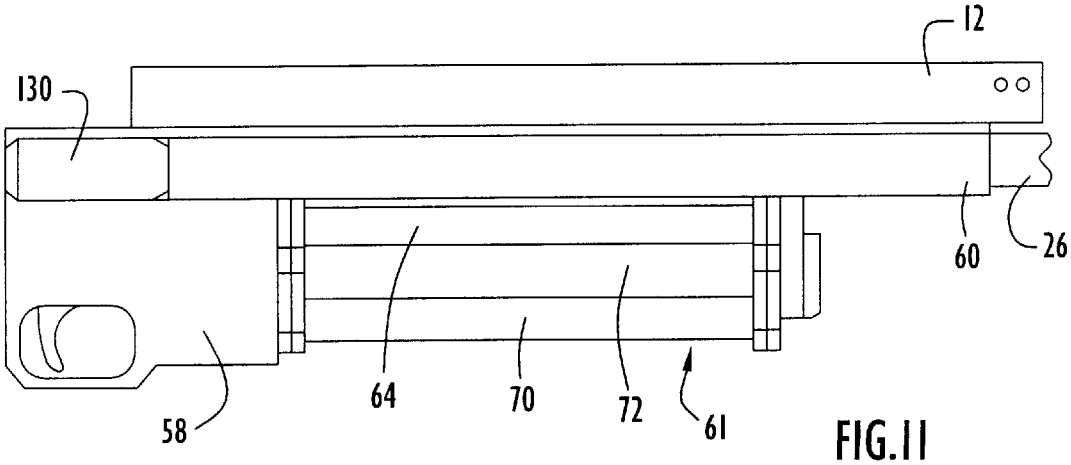
FIG. 11 is an enlarged right side view in elevation of the non-lethal weapon of the present invention.

The paintball gun pneumatic subassembly includes the compressed air reservoir 60, the compressed air delivery tube, the valve subassembly, and any ancillary refill support equipment provided on site. The valve sub assembly is incorporated into the main body subassembly 58. Compressed air reservoir 60 is preferably fabricated from aluminum (e.g., 6061 T-6) and is fashioned as a cylinder with a coupler screwing securely into the valve sub assembly. Reservoir 60 as shown in FIGS. 8 and 11 is positioned to the right of paint ball gun barrel 26 and contains sufficient compressed air to propel at least one hundred 6 gram stabilized paint balls to the full effective range of approximately one hundred meters, with a muzzle velocity of at least three hundred feet per second.

Refilling reservoir 60 is accomplished by connecting the reservoir to a large pressurized fill tank and nozzle. Replenishing equipment is in standard use in the scuba diving community and is readily available. In the preferred embodiment, as shown in FIG. 11, a quick release hose coupling attachment 130 is utilized, thus permitting the user to refill reservoir 60 without having to remove the reservoir from the paintball gun 20. Complete refill of reservoir 60 is accomplished within one minute and, by using compressed air (as opposed to $CO_2$), there is no requirement for the reservoir to be bled dry before being refilled. In the preferred embodiment, reservoir 60 includes a burst disc safety pressure release to prevent over filling and accidental rupture. Compressed air reservoir 60 is engineered to the same tolerances as scuba tanks and can be quickly removed from the paintball gun 20 by hand. The reservoir fifting includes urethane o-ring seals, thereby allowing the user to securely connect a spare reservoir to the main body subassembly 58 with simple hand tightening so that no tools are required. The compressed air delivery tube is Titanium Nitride (TiN) coated 300 series stainless steel and feeds compressed air at full pressure to the valve subassembly within main body subassembly 58. The valve subassembly steps or regulates the compressed air pressure downwardly from approximately 3000 p.s.i. (reservoir pressure) to a secondary pressure in the range of 800–1000 p.s.i. The valve sub assembly preferably includes a volume adjustment (also fabricated from 300 series stainless steel) and a power tube (preferably fabricated from brass coated 300 series stainless steel). Main body subassembly 58 includes a housing fabricated from aluminum (6061 T-6, hard coat anodized) and is preferably a machined casting. In the preferred embodiment, all pressurized connections and fittings include 90 durometer urethane o-ring seals to prevent propellant leakage.

Within the main body subassembly is a bolt subassembly (preferably TiN coated 300 series stainless steel) thereby permitting the user to charge the system and chamber the first paintball round. Once a paintball round is in the chamber, pulling trigger 22 (preferable made from 300 series stainless steel), releases a compressed air pulse stored in the power tube through four miniature vents and a void in the chamber behind the ball. Pulling the trigger also releases a spring loaded bolt to move forward to seal off the aperture between the propellant supply and the power tube, thereby preventing propellant from escaping into the chamber and outwardly through barrel 26. The compressed air pulse released into the void behind the ball pushes the ball forwardly or distally out of the chamber and down the barrel toward muzzle 24, and urges the bolt backward or proximally, reloading the spring. Forcing the bolt back into the rear position chambers another paint ball round. When the bolt is in the rearmost position, the aperture opens to release another pulse of compressed air into the power tube. The gun is now cocked and ready to fire again, thereby providing semi-automatic operation.

The barrel 26 is preferably fabricated from 6061 t-6 aluminum/ hard coat anodized to IAW MIL-spec a8625, is sixteen inches in overall length and provides an effective length of 14.25 inches. The inner diameter of barrel 26 is 0.689 inches, thereby providing proper spacing between the barrel and a stabilized paintball 30, thus preventing ammunition breakup in the barrel. Preferably the barrel is rifled in a twenty-eight land progressive polygon pattern to help seal the propelling gas behind the ball while not inducing a spin on the ball. The polygon rifling pattern helps to stabilize the ball by reducing spin-inducing propellant "leak by". By reducing the spin on paintball 30, greater accuracy at longer ranges is facilitated, since paintball ammunition tends to "tail off" in the direction of the spin as forward momentum increases. Paint ball spin is also minimized through incorporation of counter bored barrel vents 128, providing for controlled release of excess propellant gases just before the ball exits muzzle 24. The forward momentum and direction of paintball 30 are determined by the time the gases reach the vents. Releasing excess propellant gas through the vents prior to the ball exiting muzzle 24 prevents a spin inducing kick from occurring when gas escapes unevenly along one side of the ball just as the ball equator (and seam 38) exits muzzle 24.

The main body subassembly 58 includes the main housing (preferably fabricated from 6061 T-6 aluminum, hard coat anodized to IAW MIL-SPEC a8625), and the integral M203 style mounting bracket (preferably fabricated from 300 series stainless steel), the trigger guard 63, the forward hand grip, and the tactical paintball magazine attachment points and feed tray. The mounting bracket and hand grip will prevent excess heat from the M-16A2 barrel from interfering with or damaging the paintball gun 20.

Using the standard M203 mounting bracket 12 positions the paint ball gun 20 in a manner that does not interfere with firing, re-loading or servicing of rifle 10. In addition, mounting paint ball gun 20 on mount 12 provides the user with a known orientation for boresighting the paint ball gun 20, thereby simplifying the user familiarization process.

Magazine attachment points hold the magazine 23 securely at proximal and distal ends. A removable dowel fits to the center of the magazine at central axis aperture 78, allowing the user to index or rotate the magazine 23, thereby providing different tactical paint ball canisters or magazine tubes (e.g., 66, 68) in the magazine. Once one of the canisters (e.g., 64) is indexed into the loading position (as shown in FIG. 8), a spring at the front end of the canister pushes the balls proximally, one at a time, into the feed tray. As one paint ball 30 is loaded into the chamber from the feed tray, it is replaced by another from the canister.

The magazine subassembly 61 includes the five sided magazine housing (preferably made from 6061 t-6 aluminum, hard coat anodized to IAW MIL-SPEC a8625), and the cylindrical sealed canisters that each contain ten (10) stabilized paint balls. The magazine housing is an integral part of the paint ball gun 20. The canisters are preferably discarded when empty and replaced.

The paint ball gun magazine sub assembly 61 is used like the cylinder of a revolver. The user fills the magazine by insetting a ten round canister into each of the five cylindrical holes in the magazine. Springs inside the magazine tubes or canisters have sufficient strength (i.e., K or spring constant) to push the balls into the feed tray once a particular canister is indexed to the loading (top) position, regardless of the paint ball gun orientation. Once all of the balls are expended from particular canister (e.g., 64), the user simply rotates the magazine by hand while holding magazine index release 62 until the next canister (e.g., 66) aligns with the load position of the main body housing.

The fifty round magazine (with five full canisters or magazine tubes) gives a user sufficient paint ball rounds to maintain sustained, steady fire on a target. The hundred round capacity of gas reservoir 60 corresponds to two magazines of ammunition, a simple algorithm for the user to remember. The individual canisters (e.g., 64, 66, 68) are plastic extrusions. In one embodiment, the plastic extrusions are opaque to minimize paint ball deterioration during prolonged storage. A clear strip 74 down one side of the canister allows the user to inspect the contents (i.e., paint ball ammunition quantity, condition and type) without opening the canister.

Optionally, the paint ball gun is packaged with a miniaturized stadiametric range finder 19 (see FIG. 1) enabling the user to rapidly estimate the correct range to a personnel target out to approximately one hundred meters, the maximum effective range. The reduced spin on the tactical paint balls fired from the paint ball gun will achieve point target accuracy even at maximum effective range, provided that proper range-to-target estimation has been accomplished. The stadiametric range finder 19 attaches to the M16A2 carry handle 17 and incorporates a ranging reticle pattern etched on a mirror surface where the objective lens image is focused. The user simply fits the target image into the scaled ranging reticle to estimate range-to-target. The range correlates to a setting on the M16A2 rear sight, according to known ballistics of the paint ball gun 20 firing a stabilized paint ball 30. Once the adjustments are made, the user aims the paint ball gun using the M16A2 sight and fires. The highly visible paint (e.g., yellow) provides immediate hit (or miss) feedback to the user thereby facilitating use of BOT target acquisition techniques in a quick reaction or moving target situation.

Figure 14:
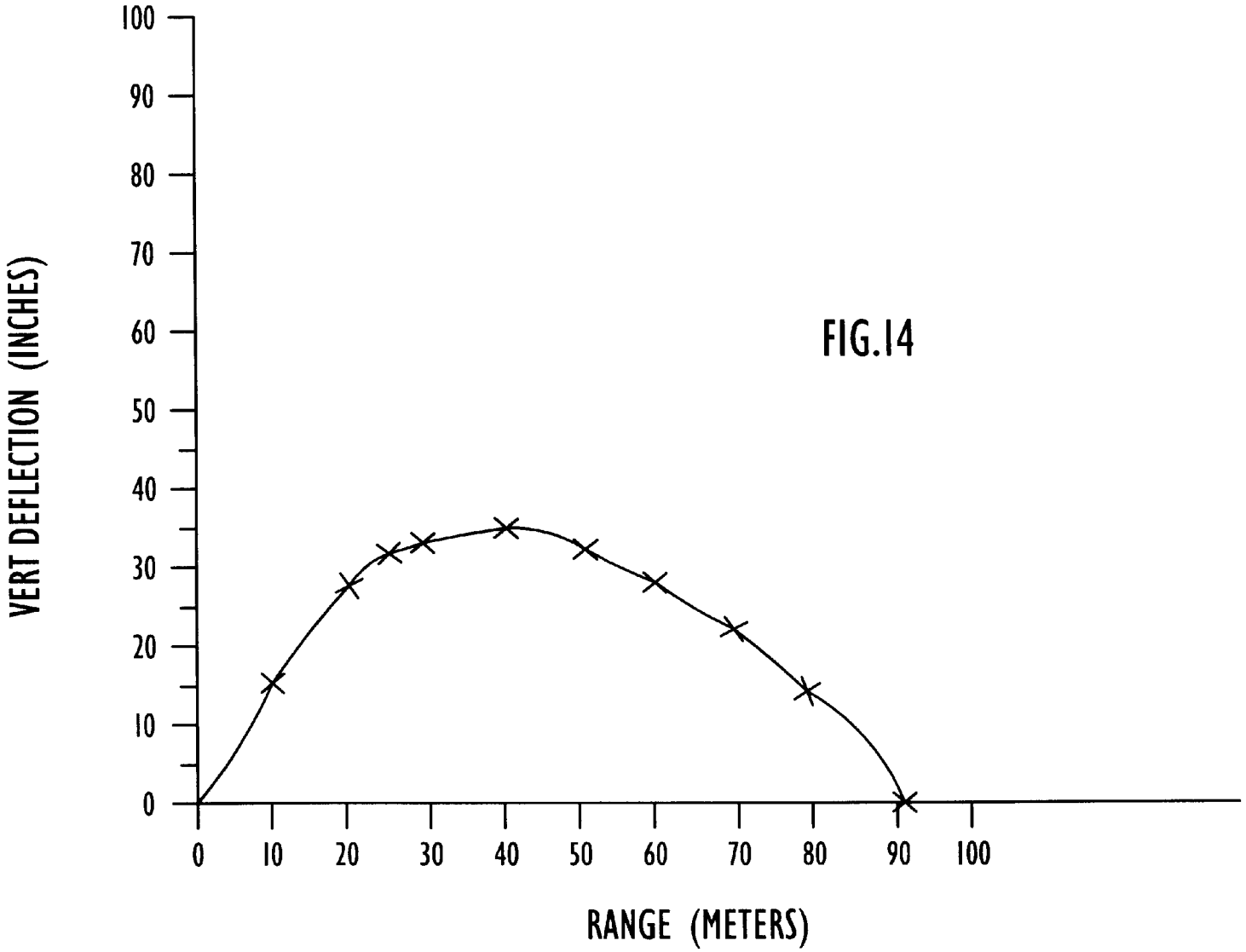
FIG. 14 graphically illustrates the vertical deflection (in inches) as a function of range of a paint ball trajectory over a range of 100 yards for the paint ball and paint ball gun of the present invention.
Figure 15:
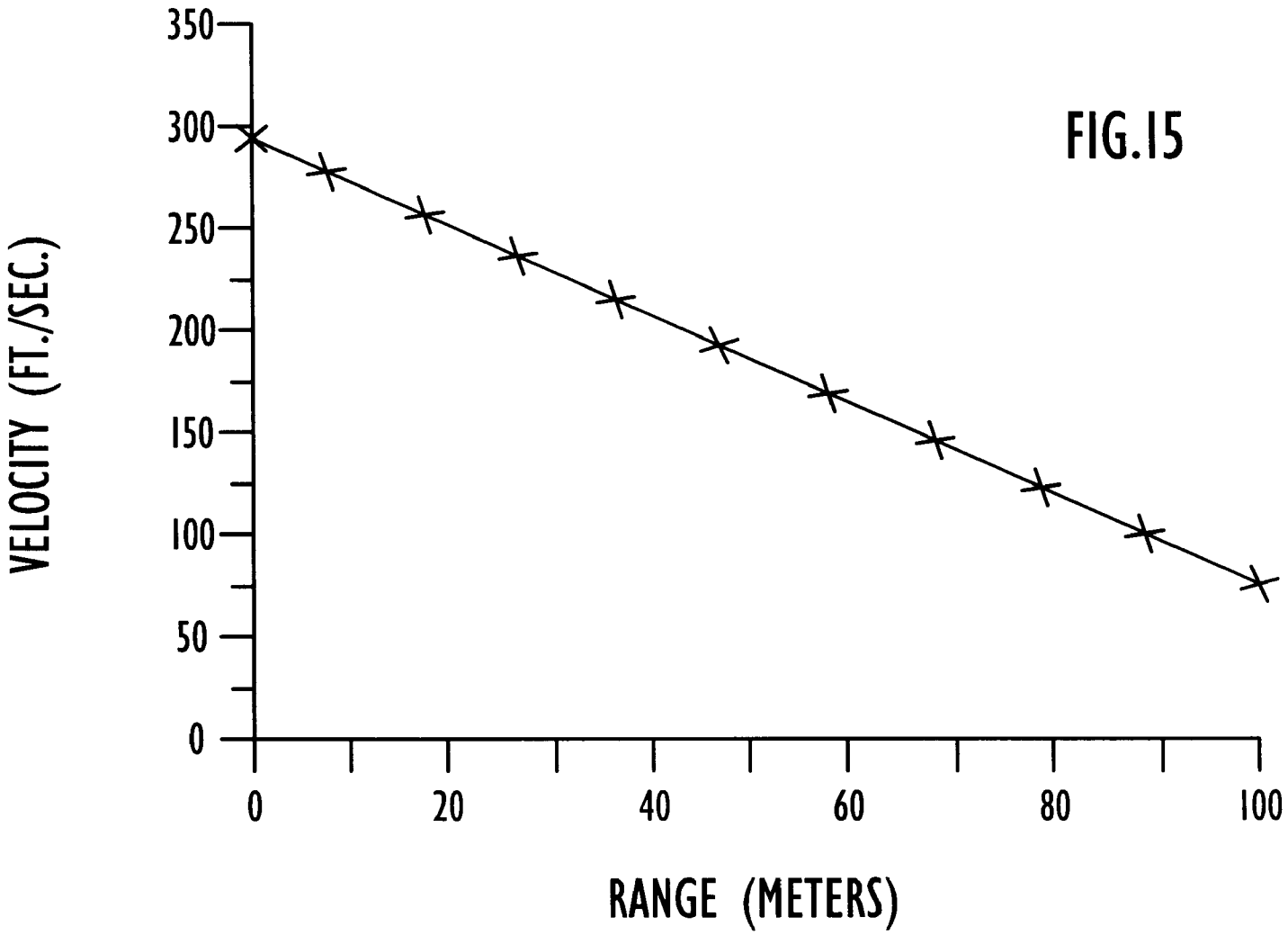
FIG. 15 graphically illustrates the velocity (in feet per second) over the effective range of 100 yards for the paint ball and paint ball gun of the present invention.
Figure 16:
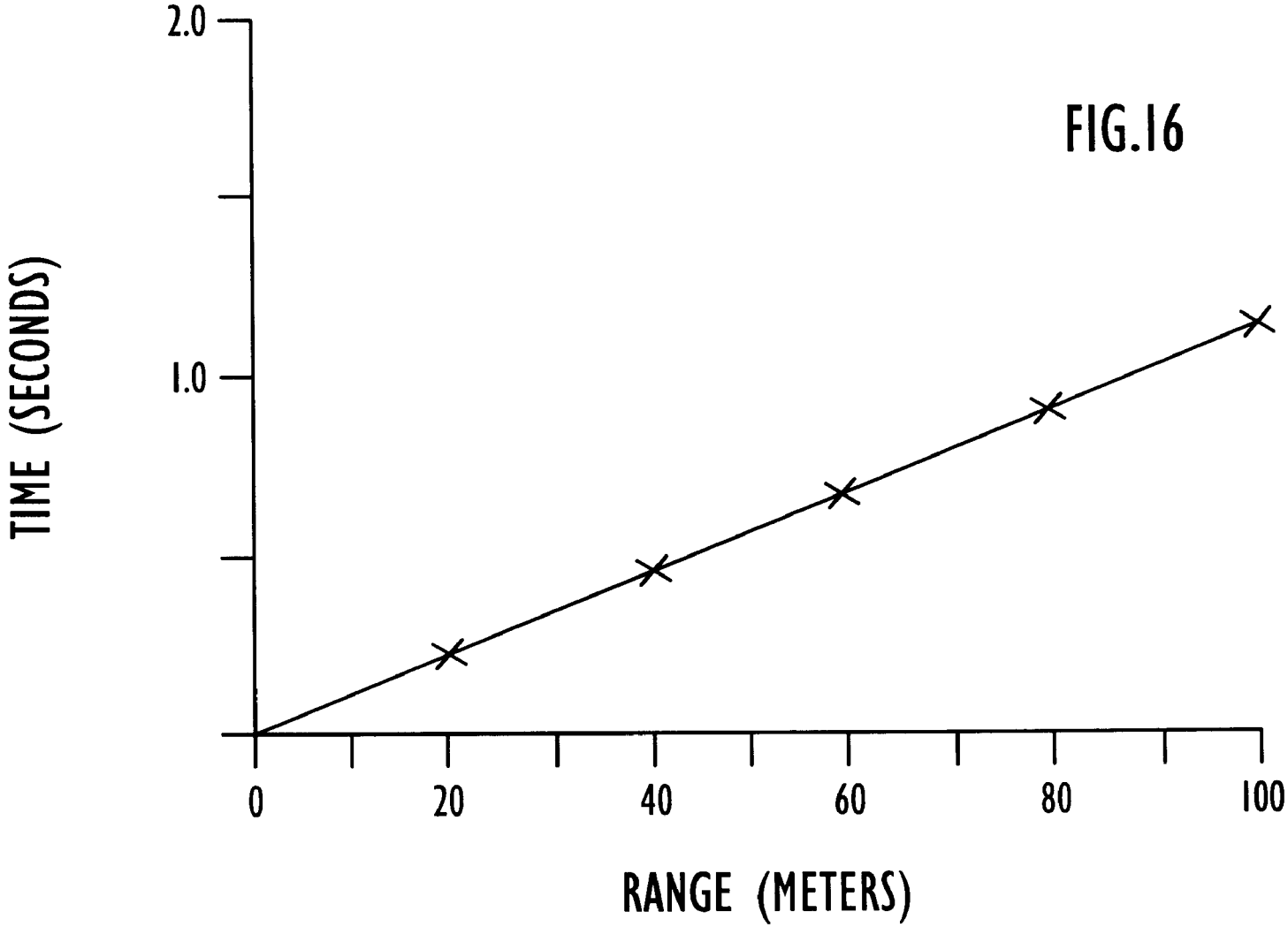
FIG. 16 graphically illustrates the time of flight (in seconds ) as a function of range, over 100 yards for the paint ball and paint ball gun of the present invention.

FIGS. 14, 15 and 16 present graphs of the ballistic characteristics of the stabilized 6 gram paint ball 30 fired from the paint ball gun 20 of the present invention. For all three graphs, a paint ball ballistic coefficient of 0.16, seventy degree temperature, atmospheric pressure of 29.5 and 78% humidity are factored in.

FIG. 14 illustrates the vertical deflection (in inches) for a paint ball gun zeroed (sighted) to a range of ninety-one meters. The point blank zero range is approximately ninety-five meters, and so at one hundred meters the point of impact is a few inches below the point of aim.

FIG. 15 illustrates the velocity (in feet per second) over the effective range of one hundred meters. At the muzzle (i.e., 0 meters) the velocity is three hundred ft./sec., and at one hundred meters the velocity has dropped to approximately seventy five ft./sec.

FIG. 16 illustrates the time of flight (in seconds) as a function of range, over one hundred meters. At one hundred meters, the time of flight is approximately 1.25 seconds, and it takes about 0.6 seconds for the ball to travel 50 meters.

Having described the preferred embodiments of a new and improved method and apparatus, it is believed that other modifications, variations and changes will be suggested to those skilled in the art in view of the teachings set forth herein. It is therefore to be understood that all such variations, modifications and changes are believed to fall within the scope of the present invention as defined by the appended claims. The above description is therefore of a preferred embodiment and is intended to be exemplary only and not limiting.

What is claimed is:

1. A projectile suitable for being fired from a weapon and rupturing upon impact with a target to disperse contents of the projectile on the target, said projectile comprising:

a fluid impermeable outer shell enclosing an interior volume and having an exterior surface;

a first material disposed within said interior volume and occupying a selected fraction of said shell interior volume;

a second, fluid material occupying substantially all the remaining shell interior volume;

wherein said first material has a specific gravity greater than said second material specific gravity and is substantially immiscible with said second material; and wherein said outer shell is rupturable in response to impact with said target to permit dispersal of said fluid material on said target.

2. The projectile of claim 1, wherein said first material comprises solid particles.

3. The projectile of claim 2, wherein said first material is grains of sand, silica particles, talc powder, glass particles, or gypsum particles.

4. The projectile of claim 2, wherein said first material comprises metal particles.

5. The projectile of claim 4, wherein said metal is aluminum, steel or lead.

6. The projectile of claim 1, wherein said first material comprises a high density, immiscible liquid.

7. The projectile of claim 6, wherein said first material is glycerin or mercury.

8. The projectile of claim 1, wherein said first material is a high density immiscible gel, a high density immiscible paste or a high density immiscible wax.

9. The projectile of claim 1, wherein said second fluid material comprises a liquid.

10. The projectile of claim 9, wherein said liquid includes paint having a selected color.

11. The projectile of claim 9, wherein said liquid includes a chemical incapacitating agent.

12. The projectile of claim 11, wherein said chemical incapacitating agent is oleoresin capasicum or chloroacetophenone.

13. The projectile of claim 9, wherein said liquid includes an additive selected from the group consisting of: an infrared dye, an odor producing agent, an ultraviolet dye, an adhesive compound, a pharmaceutical agent or chemical taggants.

14. The projectile, of claim 1 wherein said elastomeric shell has a textured exterior surface.

15. The projectile of claim 14, wherein said liquid includes an additive selected from the group consisting of: an odor producing agent, a chemical incapacitating agent, an infrared dye, an ultraviolet dye, an adhesive compound or a chemical taggant.

16. The projectile of claim 14, wherein said liquid includes an additive selected from the group consisting of: alcohol, water, paint, oil or glycerin.

17. A projectile suitable for being fired from a weapon and rupturing upon impact with a target to disperse contents of the projectile on the target, said projectile comprising:

a fluid impermeable outer shell enclosing an interior volume and having an exterior surface, said shell comprising a material that ruptures in response to impact with said target;

a first material disposed within said interior volume and occupying a selected fraction of said shell interior volume;

a second, fluid material occupying substantially all the remaining shell interior volume;

wherein said first material has a specific gravity greater than said second material specific gravity and is substantially immiscible with said second material; and wherein said projectile is free from structure and material that would prevent dispersal of said fluid material on said target in response to impact of said shell with said target.

18. The projectile of claim 17, wherein said first material comprises solid particles.

19. The projectile of claim 18, wherein said first material is grains of sand, silica particles, talc powder, glass particles, or gypsum particles.

20. The projectile of claim 18, wherein said first material comprises metal particles.

21. The projectile of claim 20, wherein said metal is aluminum, steel or lead.

22. The projectile of claim 17, wherein said first material comprises a high density, immiscible liquid.

23. The projectile of claim 22, wherein said first material is glycerin or mercury.

24. The projectile of claim 17, wherein said first material is a high density immiscible gel, a high density immiscible paste or a high density immiscible wax.

25. The projectile of claim 17, wherein said second fluid material comprises a liquid.

26. The projectile of claim 25, wherein said liquid includes paint having a selected color.

27. The projectile of claim 25, wherein said liquid includes a chemical incapacitating agent.

28. The projectile of claim 27, wherein said chemical incapacitating agent is oleoresin capasicum or chloroacetophenone.

29. The projectile of claim 25, wherein said liquid includes an additive selected from the group consisting of: an infrared dye, an odor producing agent, an ultraviolet dye, an adhesive compound, a pharmaceutical agent or chemical taggants.

30. The projectile, of claim 17 wherein said elastomeric shell has a textured exterior surface.

31. The projectile of claim 30, wherein said liquid includes an additive selected from the group consisting of: an odor producing agent, a chemical incapacitating agent, an infrared dye, an ultraviolet dye, an adhesive compound or a chemical taggant.

32. The projectile of claim 30, wherein said liquid includes an additive selected from the group consisting of: alcohol, water, paint, oil or glycerin.

* * * * *

UNITED STATES PATENT AND TRADEMARK OFFICE

CERTIFICATE OF CORRECTION

PATENT NO. : 6,223,658 B1
DATED : May 1, 2001
INVENTOR(S) : Steven P. Rosa; Fancis M. Manion It is certified that error appears in the above-identified patent and that said Letters Patent is hereby corrected as shown below:

Title page, item [76],
It is requested that the subject patent be corrected to reflect the correct spelling of the inventor's name. The inventor's name is Francis M. Manion, but through a typographical error was inadvertently presented as Francis "B" Manion. Accordingly, we are requesting a Certificate of Correction be issued to resolve this matter.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,223,658 B1
DATED : May 1, 2001
INVENTOR(S) : Steven P. Rosa and Fancis M. Manion It is certified that error appears in the above-identified patent and that said Letters Patent is hereby corrected as shown below:

Column 1,
Line 3, BACKGROUND OF THE INVENTION, insert
-- CROSS-REFERENCE TO RELATED APPLICATIONS
This application claims priority from U.S. provisional Patent Application Serial No. 60/064,461, entitled "Non-Lethal Weapon Firing a Frangible, Weighted Paint Ball" and filed November 6, 1997. --

Signed and Sealed this

Eighteenth Day of March, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,223,658 B1 
DATED : May 1, 2001
INVENTOR(S) : Stephen P. Rosa and Francis M. Manion It is certified that error appears in the above-identified patent and that said Letters Patent is hereby corrected as shown below:

Title page,
Item [76], Inventors, "Steven P. Rosa" should read -- Stephen P. Rosa --.

Signed and Sealed this

Sixth Day of May, 2003

JAMES E. ROGAN
*Director of the United States Patent and Trademark Office*